United States Patent [19]

Stouffer

[11] Patent Number: 4,579,139

[45] Date of Patent: Apr. 1, 1986

[54] SIPHON STARTER

[75] Inventor: Ronald D. Stouffer, Silver Spring, Md.

[73] Assignee: Bowles Fluidics Corporation, Columbia, Md.

[21] Appl. No.: 574,465

[22] Filed: Jan. 27, 1984

Related U.S. Application Data

[63] Continuation of Ser. No. 369,304, Apr. 16, 1982, abandoned, which is a continuation-in-part of Ser. No. 233,815, Feb. 12, 1981, abandoned.

[51] Int. Cl.[4] ..... F04F 10/00

[52] U.S. Cl. ..... 137/142; 137/571; 137/590; 137/812; 280/5 A

[58] Field of Search ..... 123/DIG. 10, 478, 509, 123/510; 137/142, 147, 571, 590, 810, 812, 813; 220/85 S; 244/135 C; 280/5 A, 5 H

[56] References Cited

U.S. PATENT DOCUMENTS

| | | | |
|---|---|---|---|
| 2,530,819 | 11/1950 | Hamlin | 280/5 H X |
| 3,006,358 | 10/1961 | Hildebrandt et al. | 280/5 A X |
| 3,021,855 | 2/1962 | Cartwright et al. | 137/142 X |
| 3,083,720 | 4/1963 | Cartwright et al. | 137/151 X |
| 3,481,180 | 12/1969 | Jones | 73/37.5 |
| 3,504,688 | 4/1970 | Jones | 137/812 |

FOREIGN PATENT DOCUMENTS

| | | | |
|---|---|---|---|
| 807206 | 6/1951 | Fed. Rep. of Germany . | |
| 2442152 | 3/1976 | Fed. Rep. of Germany | 280/5 H |
| 2440905 | 3/1976 | Fed. Rep. of Germany . | |

*Primary Examiner*—Gerald A. Michalsky

*Attorney, Agent, or Firm*—Hall, Myers & Rose

[57] ABSTRACT

The partial vacuum produced at the inlet passage of a vortex chamber is employed to move liquid from one compartment to another in order to maintain the level of liquid in at least one of the compartments within a predetermined level of the liquid in the other compartment. In one embodiment, the vortex unit or other suction means develops a partial vacuum at the maximum height of a siphon tube extending between the two chambers, the vacuum drawing fluid from both or at least one of the chambers to the top of the tube thus initiating siphoning. A sump pump having a negative pressure insufficient to lift the liquid to the maximum height of the siphon tube is employed to deliver liquid to a load and concurrently to the vortex unit to establish the required partial vacuum to initiate siphoning. The vortex unit may also be located in the siphon tube and may be used as a pump to deliver liquid from only one compartment to another or in another embodiment as a siphon to move liquid in both directions to maintain liquid in the two containers within a prescribed difference in height of one another.

31 Claims, 13 Drawing Figures

FIG. 1
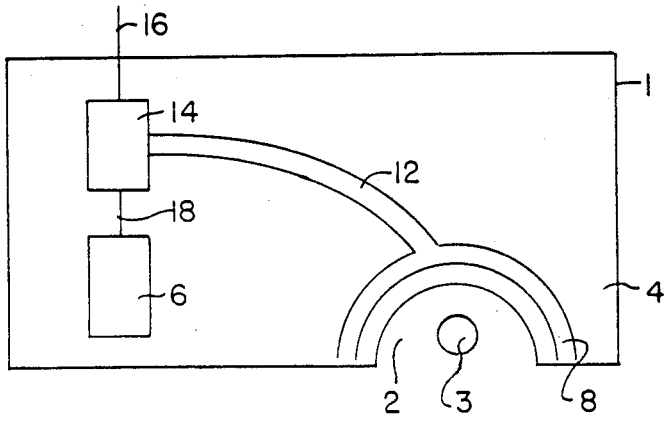
FIG. 2
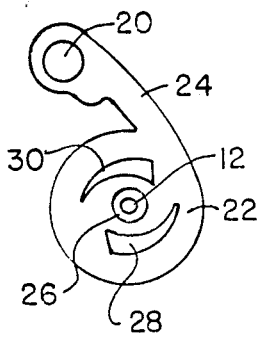
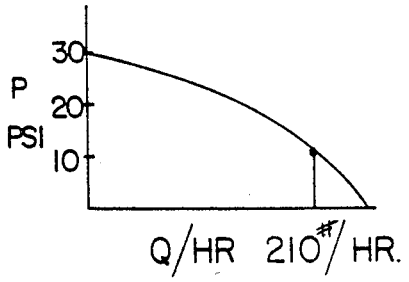
FIG. 3
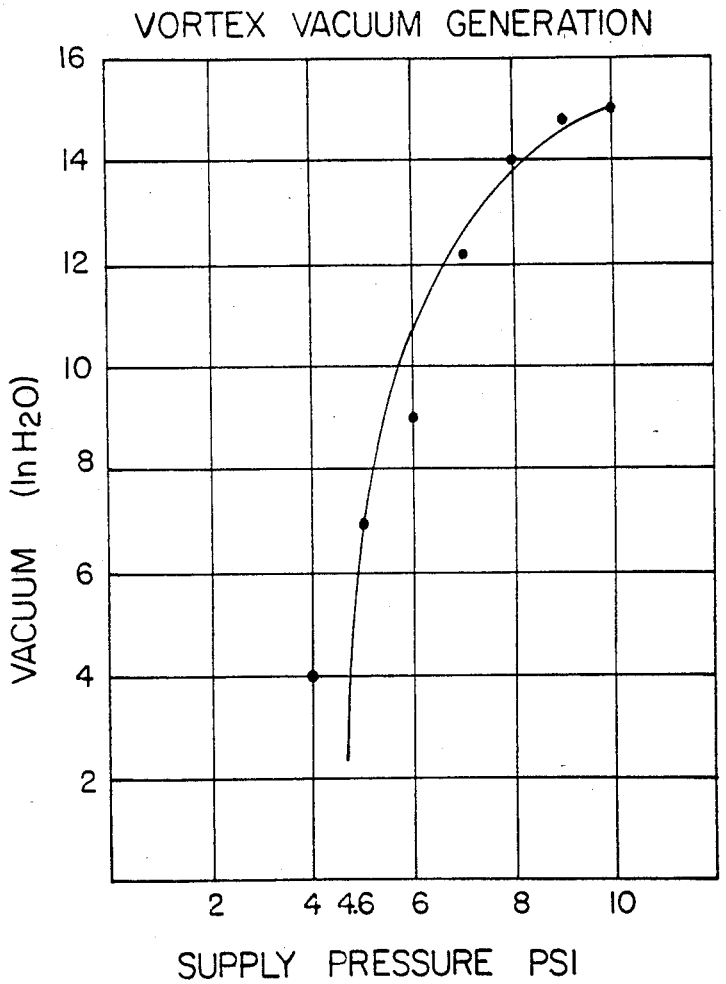
FIG. 4

FIG. 9
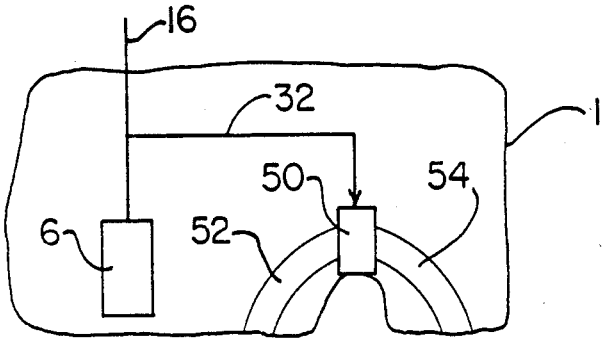
FIG. 10
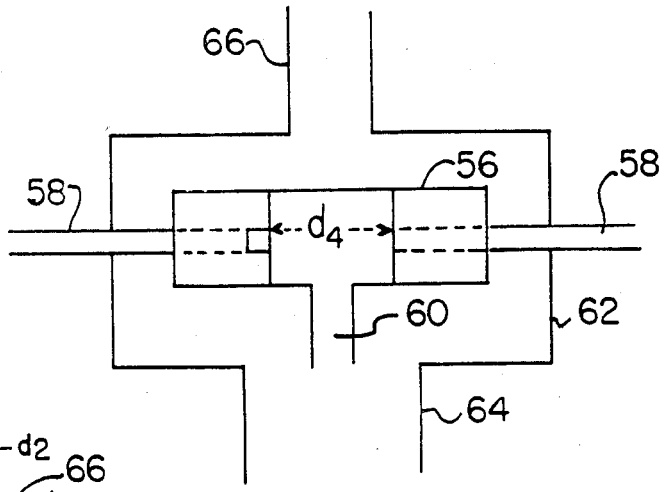
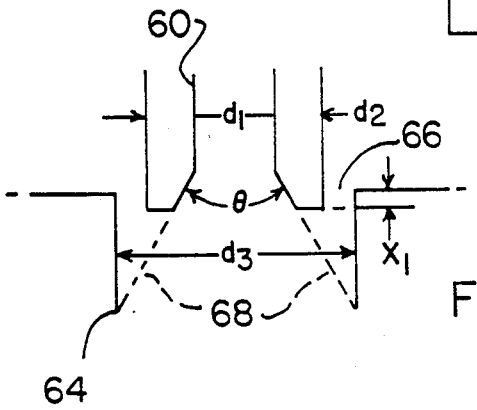
FIG. 11
FIG. 12
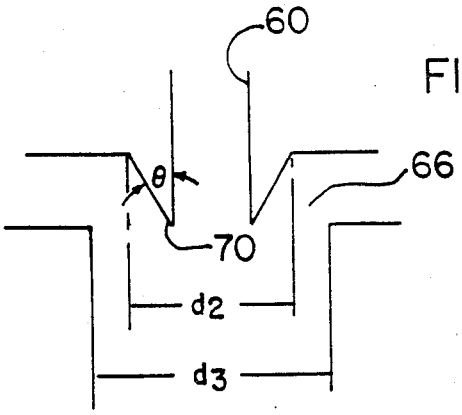
FIG. 13
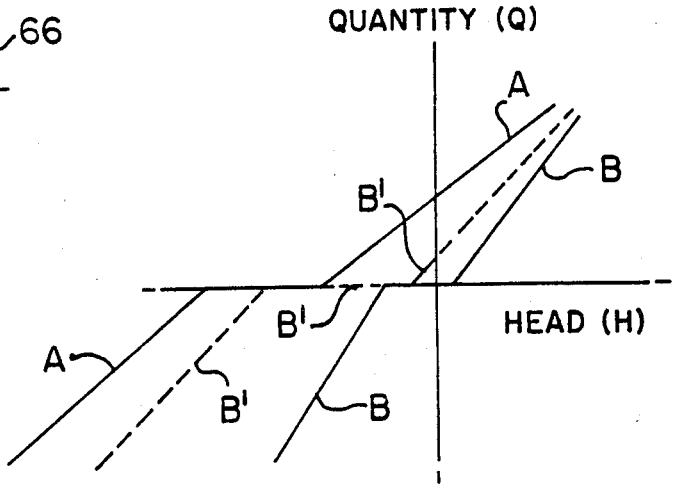

SIPHON STARTER

This a continuation, of application Ser. No. 369,304 filed Apr. 16, 1982, now abandoned, which was a continuation-in-part of Ser. No. 233,815, Feb. 12, 1981, now abandoned.

DESCRIPTION

The present invention relates to siphons and vortex devices, and particularly to a method of and apparatus for transferring liquid from one compartment to another compartment of a sealed container utilizing the partial vacuum created in the output passage of the vortex device as the siphon initiating force.

With the development in recent years of very small compact vehicles, problems have arisen as a result of reduction in available space for various elements of the vehicle. In a recent design of a motor vehicle, a vertical indentation must be provided in the bottom surface of the gas tank to accommodate the car's tail pipe while maintaining the gas tank in an acceptable position both with respect to the ground and the rear of the vehicle. The problem with such an arrangement is that the vertical indentation in the bottom of the tank presents an obstacle to the free flow of liquid from at least one of the compartments formed by the obstacle.

In a particular vehicle which uses a throttle body injector, a turbine pump is located in the gas tank for pumping fluid to the injector. The pump can withdraw liquid from only one side of the vertical obstacle; being a sump-type pump it does not have sufficient negative pressure to draw liquid over the obstacle. The sump pump is preferred because of its high efficiency. In such a system, it is critical that no material reduction in pressure be encountered in the flow from the pump to the throttle body injector thus prohibiting the use of venturis. Further, the system cannot tolerate the diversion of an appreciable quantity of liquid being pumped to the injector. A further constraint on the system is that moving parts such as ball valves, spring biased valves, etc., cannot be tolerated in such an environment. To date, a suitable solution has not been found to this problem.

Brief Description of the Present Invention

In accordance with one aspect of the present invention, a vortex valve, driven by liquid flow from a sump-type pump is employed to transfer liquid from a first compartment to a second compartment and in one embodiment of the invention, to transfer liquid in both directions depending upon which compartment has the higher level of liquid.

In accordance with one embodiment of the present invention, the vortex device which is driven by the sump pump is utilized to create a sufficient suction in a siphon tube to raise the level of liquid therein over the obstacle and initiate a siphoning action between the compartment remote from the pump and the compartment in which the pump is located. The vortex valve may be located in series with the flow of fluid from the pump to the throttle body injector or may be in effect a shunt to ground, that is, may tap off a small amount of liquid from the conduit leading to the throttle body injector internally of the gas tank and return the small amount of diverted fluid to the tank.

In a situation where the vortex valve is in series with the flow from the pump to the conduit, a vortex valve having a relatively small pressure drop is utilized; the pressure drop being controlled by the relative radii of the main vortex valve chamber and the outlet passage. In a system where the vortex valve constitutes a shunt to ground or shunt to sump, the ratio of the radius of the vortex chamber to the radius of the outlet passage is made quite large so that a very high impedance to flow is developed and relatively little fluid is diverted from the main flow.

The theory underlying vortex valves and vortex amplifiers which ever term is preferred may be found in U.S. Pat. Nos. as follows: 3,276,259; 3,320,815; 3,413,995; 3,410,143; 3,504,688 and the like.

The specific problem with which the present invention must treat arises when one understands that the pump which is preferred in the particular environment with which the present invention is dealing is a sump pump or, specifically, a pump that extends down into the body of liquid and uses blades or other means to move the liquid in which it is emersed up into the conduit. As a result, virtually no negative pressure is developed on the input side of the pump. Thus, it is not possible to employ a pump generated negative pressure or partial vacuum to draw fluid through a siphon tube over the indentation or obstacle in the floor of the gas tank. Since the outflow from the pump is the only moving fluid available, this flow must be utilized to initiate the vacuum.

In accordance with another feature of the present invention, a siphon tube extends between the two isolated chambers. A vacuum tube enters this siphon tube at approximately its maximum vertical height so that suction in the vacuum tube pulls fluid equally from both chambers to the height of the vacuum tube and perhaps partially into the vacuum tube. In consequence, the siphon tube is maintained full of liquid at all times, and once the level of fluid in the compartment in which the pump is located falls below the maximum height of the vertical indentation or obstacle in the tank, fluid begins to flow from the isolated chamber into the chamber containing the pump or vice versa if due to a bump or inclination of the vehicle, the liquid in the pump compartment is higher than in the other compartment.

As indicated above, it is known that a vortex valve will, in its output passage, develop a negative pressure which can be made quite high depending upon the physical construction of the device. Supply pressures of 10–15 psi are quite common and in the particular environment under consideration, a resulting negative pressure of 4 inches at the output of the vortex is readily obtainable and is sufficient for the intended purpose.

In other embodiments of the present invention, the vortex valve is inserted in the tube extending between the two compartments whereby the suction created by flow of liquid through the vortex device pulls up the liquid in the isolated compartment and directs it to the other chamber along with the liquid flowing through the vortex valve. By proper proportioning of the device, it will operate as a one-way or a two-way pump. In the former case, fluid is constantly pumped from the remote compartment to the compartment with the pump so long as the differential in levels is within a prescribed range. In the latter case, the device moves the fluid alternatively in one or the other direction again depending upon the difference in levels of liquid with a central dead band being provided to prevent constant movement of fluid.

The advantage of this latter configuration is that only one sender is required to provide a proper fuel level reading. If two-way flow is not provided, then two fuel gauge senders would be required; one in each compartment, together with proper proportioning based on capacity of each compartment in order to provide a relatively accurate reading of remaining fuel. By using a two-way siphon, the levels in the compartments are held within acceptable height variations.

One of the most important features of the present invention is that the controlling orifice, the outlet orifice of the vortex unit, is physically considerably larger than a venturi of comparable performance capability and is far less subject to clogging or damage in the dirty environment of a gas tank and does not require filtering which would be a service nightmare.

It is an object of the present invention to provide a system for moving liquid from one compartment into another compartment separated by a vertical obstacle by means of a siphon tube wherein liquid is maintained in the siphon tube at least at the maximum height of the siphon tube by a vacuum line sensing the reduced pressure region of a vortex valve.

It is another object of the present invention to utilize a low pressure drop vortex valve to develop a negative pressure in a suction tube for purposes of raising liquid in a siphon tube to a height exceeding the vertical height of an obstacle between the two containers adapted to contain liquid.

Another object of the present invention is to utilize the negative pressure in or adjacent to the outlet passage of a vortex valve for purposes of causing flow of fluid between compartments either by siphoning or pumping or a combination of both.

It is yet another object of the present invention to provide a vortex valve for diverting a small portion of the fluid flowing in a main conduit to develop a negative pressure in the output passage of the vortex valve whereby to cause fluid to flow between two compartments by siphoning, pumping or a combination of both effects.

BRIEF DESCRIPTION OF THE DRAWINGS

FIG. 1 is a simplified diagrammatic view of one embodiment of the present invention.

FIG. 2 is a plan view of a vortex valve which may be utilized in the system of FIG. 1.

FIG. 3 is a graph showing the interrelationship of vacuum developed in the output tube of a vortex valve and the supply pressure to the valve.

FIG. 4 is a graph illustrating a particular curve of pressure required to produce a particular quantity of flow in a system with which the present invention is concerned.

FIG. 9 is a simplified diagrammatic view of a further basic embodiment of the present invention.

FIG. 10 is a front diagrammatic view of the vortex chamber and the surrounding passageway employed in FIG. 9.

FIG. 11 is a detailed view of one form of the interaction region of the device of FIG. 10.

FIG. 12 is a detailed view of another form of the interaction region of the device of FIG. 10.

FIG. 13 is a graph illustrating the flow of liquid between compartments as a function of liquid head for the interaction region of FIGS. 11 and 12.

DESCRIPTION OF PREFERRED EMBODIMENTS

Figure 5:
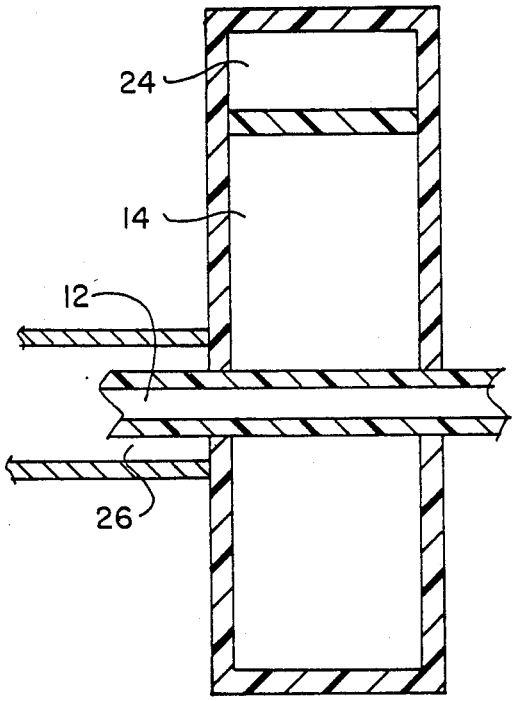
FIG. 5 is a side view in elevation illustrating the interrelationship between the vortex chamber, the output tube and the pressure sensing tube of the apparatus of FIG. 2 of the accompanying drawings.

Referring now specifically to FIG. 1 of the accompanying drawings, there is illustrated a gas tank 1 having a vertical indentation 2 in its bottom surface to accommodate a tail pipe or exhaust pipe 3 of the vehicle. It can be seen that below the level of the maximum height of the indentation 2, which level is designated by the reference numeral 4, the gas tank is divided into a left and a right compartment. In systems which utilize throttle body injectors and in some systems which utilize carburetors and diesel injectors, it is becoming common to increase fuel efficiency by employing a sump-type pump 6 for pumping fluid out of the gas tank 1 and to the general vicinity of the engine.

Sump pumps as indicated previously are situated in the liquid and do not have an appreciable negative pressure or, in fact, a readily measurable negative pressure. Also, it is important, due to considerations of utilization of energy, cost and size of the pump, and related economic and efficiency factors, that as little interference with the flow from the pump 6 be encountered in attempting to move fluid from the right compartment of the tank to the left compartment of the tank. Further, due to the environment in which this sytem is operating and the inaccessibility of the interior of the gas tank, it is important that moving parts not be utilized to initiate siphoning of fluid from the right compartment to the left compartment.

In accordance with one embodiment of the present invention, the siphoning is accomplished by means of a siphon tube 8 which extends over the vertical obstacle 2 of the tank and into the right and left compartments as viewed in FIG. 1 herein. Since there is effectively no negative pressure at the inlet side of the pump 6, it is not possible to utilize the pump directly to suck on the left end of the suction tube 8 to thereby initiate a siphoning action. The present invention, instead of sucking on the end of the tube, creates suction at the vertical apex of the tube 8 to draw liquid from both compartments of the tank 1 to the maximum height of the siphon tube 8 or even higher. Thus, when the fluid in the left compartment falls below the level 4, that is, below the level of the fluid in the right compartment, the siphoning action is initiated and the right compartment is drained concurrently with the left compartment.

The suction at the top of the pipe 8 is applied via a suction tube 12 which is connected to sense the negative pressure in the outlet passage of a vortex valve or amplifier 14. In FIG. 1, the vortex amplifier is connected in series between the pump 6 and outlet conduit 16 which conveys or conducts fluid to the throttle body injector or the carburetor or the injectors of a diesel engine.

The configuration of the vortex valve which may be utilized in the series arrangement illustrated in FIG. 1 of the accompanying drawings, is illustrated in FIGS. 2 and 3. Fluid which is pumped into a conduit 18 by the pump 6 is introduced via an inlet passage 20 of the vortex valve and applied tangentially to a circular chamber 22 of the valve via a passage 24 extending between the passage 20 and the chamber 22. The suction line 12 is situated in the outlet passage 26 preferably in a position of maximum negative static pressure developed in the outlet passage.

In accordance with standard vortex theory, the fluid flowing through the passage 24 enters the chamber 22 tangentially and swirls in an ever radially decreasing vortical or helical pattern and enters the outlet passage 26 at a greatly reduced static pressure and develops a negative static pressure internally of the passage. The dynamic pressure of the fluid, of course, is very high at this point due to the very rapid rotation of the fluid in its transfer from the circumference of the chamber to the small outlet passage.

In the configuration illustrated in FIG. 2, islands 28 and 30 are introduced to partially reduce the vorticity in the chamber to thereby reduce the pressure drop in the apparatus. As previously indicated, in a system such as that of the present invention, it is important for the sake of economics and efficiency to utilize as small an amount of energy as possible in driving the pump 6. Thus, as little pressure drop above that required to initiate siphoning should be an end goal.

In this context, reference is made now to the graph of FIG. 4 which plots vacuum against supply pressure in a typical vortex valve. It will be noted that the four inches which in the particular application for which the invention was developed is essential, was achieved with an available vortex valve with a supply pressure to the valve of only 4.6 psi. Lower pressure drops may be achieved. Thus, very great vorticity is not required in the apparatus when a vortex valve is utilized in series between the pump 6 and the outlet conduit 16. The siphon system must, of course, be designed with the flow characteristics of the total system in mind.

Reference is now made to FIG. 3 of the accompanying drawings which illustrates a typical Pressure versus Quantity of flow curve, for a two-stage turbine pump such as that employed in a throttle body injector system. Reference to FIG. 3 indicates that a desired flow of 210 pounds of fuel per hour is achieved with a pressure of 10 psi. If a 4.6 psi drop in line pressure, or even smaller, is achieved, then a total pressure from the pump of only 15 psi or less is required to achieve the desired flow to the engine.

By utilizing the quasi flow straighteners 28 and 30 in FIG. 2, the degree of vorticity of the valve of FIG. 2 is controlled to provide the desired pressure drop. It should be noted again that the vorticity of the fluid and the pressure drop across the valve is also a function of the relative diameters of the chamber 22 and the effective diameter of the outlet passage 26 taking into account the reduction in cross-sectional area of the tube 26 resulting from the introduction of the pipe 12 therein. In any event, the overall configuration must be such as to minimize the pressure drop across the valve; 4.6 psi or less in a properly designed system (which consideration eliminates the use of venturis). Thus, referring again to FIG. 3, the 10 psi pressure required to obtain 210 pounds per hour of flow under these circumstances may readily be achieved with a supply of pressure of less than 15 psi.

Referring now specifically to FIG. 5 of the accompanying drawings, the arrangement of the outlet pipe 26 and the vacuum tube pipe 12 is more fully illustrated. The inlet passage 24 is also shown but the islands 28 to 30 have been eliminated for the purposes of clarity. For ease in mechanical assembly, the suction tube 12 enters the outlet tube 26 through the opposite wall of the chamber so that no obstruction is introduced into the passage 26 in bringing the tube 12 out through a side wall.

Figure 6:
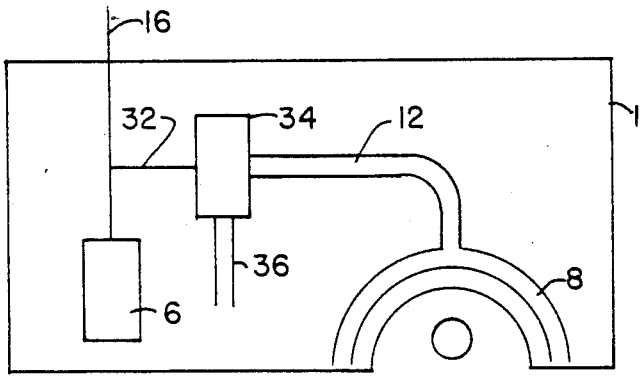
FIG. 6 is a simplified diagrammatic view of a second embodiment of the present invention.

Referring now specifically to FIG. 6 of the accompanying drawings, there is illustrated an arrangement for utilizing what might be called a shunt to sump arrangement wherein the vortex valve is not in series with the pump 6 but taps off a portion of the fluid directed to the conduit 16 and utilizes this diverted fluid for the operation of the vortex valve and the development of the necessary negative pressure or partial vacuum in the line 12. In this instance, a tap-off pipe 32 supplies fluid to a vortex valve 34, the output of which is returned via output passage 36 of the vortex valve 34 to the tank 1. In this embodiment in order to minimize the amount of fluid that must be bled from the line 16, a maximum pressure drop is developed across the vortex valve. An advantage of this arrangement is that clogging of the vortex valve does not impede flow to the injector.

Figure 7:
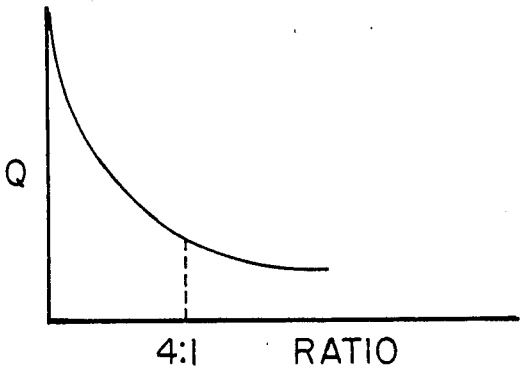
FIG. 7 is a graph illustrating the variation of flow through a vortex valve as a function of the ratio of the input diameter of the vortex chamber to the effective output diameter of the output passage.

Reference is now made to FIG. 7 which is a plot of flow as a function of ratio of the inlet radius of the vortex chamber to the effective radius of the output pipe. It will be noted that, as the ratio increases, the flow through the vortex valve decreases rapidly but the curve displays a knee at about a ratio of 4 to 1. Although the flow thereafter continues to decrease, it decreases at a much less rapid rate. An input to output radius ratio of 4 to 1 may be utilized in the configuration of FIG. 6 thereby achieving a relatively small body size.

Figure 8:
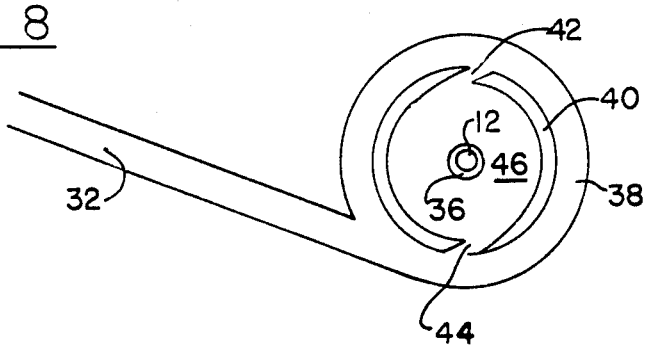
FIG. 8 is a plan view of a vortex valve which may be utilized with the embodiment of FIG. 6 of the accompanying drawings.

A suitable vortex valve for such a use is illustrated in FIG. 8 in which the line 32 is introduced tangentially into a chamber 38 having an inner or annular wall 40 disposed therein and spaced inwardly therefrom to define a passage between the annulus 38 and the outer wall of the chamber 38. The wall 40 is provided with two passages 42 and 44 (or other suitable number of passages) which extend through the wall and into an inner chamber 46 defined by the wall 40 generally tangentially thereto. Output pipe 36 is disposed coaxially with the wall 40 and sensing tube 12 is located within the tube 36. The ratio of the outer wall or the inner surface of the annular wall 40 to the effective radius of the output pipe, that is, the radius taking into account the fact that pipe 12 is disclosed therein, is at least 4 to 1, thereby maximizing the pressure drop across the apparatus. In the configuration of the apparatus of FIG. 8, vacuums of 15 psi and greater have been readily achieved which are obviously more than ample to raise the liquid into siphon 8 by far greater than the necessary four inches.

The choice of the series or shunt to sump embodiments of FIG. 1 or FIG. 6, respectively, in a particular system will be determined by many factors which are beyond the control of the designer of the vortex amplifier; specifically, the flow requirements of a particular system, the efficiency of the pump, whether the pump can be readily designed to or has excess pressure or excess flow. If excess pressure is available, then a series valve will be utilized. If excess flow is available, then a shunt to sump valve will be employed. These facts are readily apparent by reference to FIGS. 3 and 7 which show respectively the vortex valve performance curve achieving the necessary four inches suction with a pressure thereacross of 4.6 psi whereas the large reduction in flow achieved on a 4 to 1 input to output radius ratio discloses the low requirements for diversion of fuel for use with a system with excess fuel flow capacity.

In the arrangements thus far described, the vortex valves are employed to raise the level of liquid in a siphon tube to the maximum height of the tube, thus permitting siphoning of fluid from either chamber to the other depending upon in which compartment the level of liquid is the highest. In both systems, the serial and dump to sump systems, unassisted siphoning is employed.

In two further embodiments of the invention, the vortex valve is employed as an active element, or amplifier, in series in the siphoning system. Referring specifically to FIG. 9 of the accompanying drawing, the gas tank 1 again has the sump pump 6 located therein and conduit 16 for carrying fuel from the tank to the engine, not illustrated. A portion of the liquid delivered to conduit 16 is bled off through conduit 32 to vortex valve 50. The valve 50 is located in the siphon tube; in the illustration constituting two lengths of tubing 52 and 54 extending in to the left and right compartment respectively of the tank 1.

The vortex unit 50 of FIG. 9 consists of a hollow flat cylindrical vortex chamber 56 (see FIG. 10) having tangential inlet passages 58 and a coaxial outlet passage 60. The vortex chamber and outlet is surrounded by a hollow flat cylindrical outer chamber 62 having coaxial inlet and outlet passages 64 and 66 connected to siphon tubes 52 and 54 respectively. The size of the passages between the cylinders 56 and 62 are not critical except that the passages must be large enough to permit the required rate of flow between chambers while at the same time establishing rapid enough flow to clear out vapor bubbles. The important configurations and dimensions; however, relate to the region of interaction between the flow through tube 60 and the flow between the two chambers 56 and 62.

Initially reference is made to FIG. 13 of the accompanying drawings which is a plot of quantity of flow, Q, as a function of head, H, between the two chambers.

In a "pump" configuration, flow, as indicated by Graph A, is predominately from the right compartment to the left or sump pump containing compartment. The head, H, is positive if the level of fluid in the right compartment is higher than in the left compartment. The graph shows that the vortex pump continues to move fluid to the left compartment even though it is at a higher level than the right compartment and only stops such pumping when the head is negative by a predetermined design value.

The negative segment of curve A indicates the obvious, if the head in the left compartment is greater than that which can be developed by the vortex pump, the pump is overwhelmed and fluid flows backwards; i.e. to the right compartment. If only the pumping action is desired, the head necessary to produce this latter effect is greater than that which can be produced as a result of the barrier between compartments and as a practical matter cannot be achieved In a "siphon" configuration, the liquid, as indicated by Graph B, flows in both directions; the direction of flow being determined by whether the head, H, is positive or negative. As indicated previously, such an arrangement is desired so that only one sender is required for the fuel gauge.

The dashed line, Graph $B^1$, indicates a siphon having a greater hysteresis than Graph B; specifically, the head required to initiate flow in either direction is greater than in the Graph B configuration. As indicated subsequently, the hysteresis is a function of the relative dimensions and locations of the passages 60 and 64 and reference is now made to FIG. 11 of the accompanying drawings.

In the configuration of FIG. 11, the following dimensions were employed in successful tests:

$\theta=41°$
$d_1=0.048''-0.052''$
$d_2=0.15''$
$d_3=0.43''-0.44''$
$X_1=0.025''-0.05''$
$d_4$ (FIG. 10)$=0.31''$ The value of $\theta$ is not critical, 41° being exemplary. As to diameters $d_1$–$d_4$, the relative values are of more importance than the absolute values. As to dimension $d_3$, as the ratio of $d_3/d_2$ gets smaller and/or the overlap $X_1$ increases, in other words, the volume of the passage between the walls of the outlet 60 and the pipe 64 decreases, the device increasingly exhibits the characteristics of Graph A of FIG. 13; the pump characteristics. Initially the curve B is increased in slope and the hysteresis increases, See Graph $B^1$, until eventually Graph A is approximated. Conversely, as the ratio $d_3/d_2$ and/or the value of X increases, the Curve B is approached, but the device cannot achieve the function of a perfect siphon, i.e. a curve that passes through the origin with no hysteresis.

It should be noted that the Graph A and the other graphs are asymmetrical with respect to the origin; the preferred direction of movement being in the direction of flow out of the tube 60.

The configuration of FIG. 11 makes a good siphon but a less desirable pump. Specifically, to obtain a good pump, there must be close coupling between the flow from the tube 60 and the liquid in region 66. Due, however, to the thickness of the wall of the outlet 60, the liquid flow out of passage 60, as defined by dashed line 68, is remote from the region 66. Thus, the suction effect is not strong and pumping is not efficient. On the other hand, siphoning requires less direct coupling between the region 66 and the flow from the tube 60, thereby permitting reversal of flow; specifically, flow is more dependent on head, H, than in the case of close coupling.

Reference is now made to FIG. 12 of the accompanying drawings wherein the dimensions of FIG. 11 apply except as indicated below:

$d_3$
Pump$=0.37-0.39$
Siphon$=0.44-0.48$

In this embodiment of the invention, the outer wall or surface 70 of the outlet 60 is tapered whereby by controlling the angle $\theta$, and/or the diameter $d_3$ and/or the dimension $X_1$, the coupling between the flow from outlet 60 and region 66 may be readily determined and pump or siphon operation determined. As previously indicated and as brought out by the dimensions of $d_3$, above, with all other dimensions being the same as in FIG. 11, pump operation is achieved with close coupling, $d_3=0.37-0.39$, and excellent siphon operation is achieved with looser coupling, $d_3=0.48$ etc.

The present invention has been described for utilization in a particular environment. However, it is apparent that this sytem may be utilized wherever the problems discussed herein are encountered.

Once given the above disclosure, other features, modifications, and improvements will become apparent to one skilled in the art. Such other modifications, features and improvements are, therefore, considered a part of this invention, the scope of which is to be determined by the following claims.

I claim:

1. An apparatus for pumping liquid from a compartmentalized container, comprising a container having at least two compartments, a generally vertical obstacle separating said compartments, conduit means extending between said compartments over said obstacle, a pump means for pumping fluid out of said container through an outlet and for ingesting fluid into said pump through an inlet at a negative pressure with said inlet extending into one of said compartments, said pump means having a negative pressure at its inlet less than that required to lift liquid in one of said compartments over said obstacle, suction means communicating with said conduit means at approximately the maximum vertical height of said conduit means, and vortex means responsive to flow of liquid from said pump and through said vortex means for developing a negative pressure in said suction means sufficient to lift liquid in said compartments to the maximum height of said conduit means.

2. An apparatus as defined in claim 1 wherein said vortex means responsive to flow of fluid is a vortex valve receiving input fluid from said outlet of said pump means.

3. An apparatus as defined in claim 2 wherein said vortex valve has a central outlet passage, said suction means extending into a region of negative pressure in said outlet passage of said vortex valve.

4. An apparatu,s as defined in claim 1 wherein said means responsive to flow of liquid comprises a vortex valve, said vortex valve having a flat hollow cylindrical chamber and an outlet passage coaxial with the axis of said chamber, means for introducing liquid flowing through said outlet of said pump means into said chamber tangential to the inner circumference thereof, said conduit means extending into a region of negative pressure in said outlet passage of said vortex valve.

5. An apparatus as defined in claim 3 or claim 4 further comprising a conduit for conducting fluid out of said container, said outlet passage of said vortex valve connected to said conduit to supply all of the fluid supplied to said vortex valve to said conduit.

6. An apparatus as defined in claim 3 or claim 4 further comprising a conduit for conducting fluid out of said container, said conduit connected to said outlet of said pump means, and means for supplying a part of the fluid flowing in said conduit to said vortex valve, said outlet passage of said vortex valve supplying fluid to said container.

7. An apparatus as defined in claim 1 wherein said vortex means is a vortex amplifier and comprises a vortex chamber having a centrally located egress orifice, an enclosure defining a continuous flow path extending about the periphery of said vortex chamber, said conduits entering opposed ends of said enclosure, said egress orifice directing liquid into an end of one of said conduits extending into said enclosure, and means responsive to flow of liquid to said utilization device for introducing liquid tangentially into said vortex chamber generally at a location at its maximum diameter.

8. An apparatus as defined in claim 7 wherein said egress orifice of said vortex amplifier extends into said end of said one of said conduits, said egress orifice being defined by a wall interiorly tapered outward towards its end.

9. An apparatus as defined in claim 8 wherein the ratio of the exterior surface of said wall to the interior surface of said one of said conduits is approximately one-third.

10. An apparatus as defined in claim 9 wherein the angle of taper of said wall is approximately 41°.

11. An apparatus as defined in claim 9 wherein said wall extends into one of said conduits by 0.025 to 0.05 inch.

12. An apparatus as defined in claim 7 wherein said egress orifice of said vortex amplifier extends into said end of said one of said conduits, said egress orifice being defined by a wall that is tapered on its exterior surface to a thickness of minimum dimension at its end.

13. An apparatus as defined in claim 11 or claim 12 wherein the ratio of diameters of said wall to the outer diameter of said conduit is in the range of 0.385 to 0.41.

14. An apparatus as defined in claim 11 or claim 12 wherein the ratio of the diameters of said wall to the outer diameter of said conduit is in the range of 0.312 to 0.341.

15. An apparatus according to claim 1 wherein said pump is a sump pump and is located in said container.

16. An apparatus for pumping liquid from a container having at least two compartments and an obstacle separating said compartments, said apparatus comprising means extending between said compartments and over said obstacle for transferring liquid between said compartments, a pump having an inlet and an outlet, said transferring means including a first conduit, a second conduit, and vortex means for developing negative pressure in one of said conduits sufficient to raise the liquid in said one conduit to at least the maximum height of said conduits, said first and said second conduits being connected to said developing means, thereby forming a flow path for said liquid, said means for developing being responsive to the flow of the liquid through said outlet of said pump.

17. An apparatus as defined in claim 16 wherein said first and second conduits are two sections of one continuous conduit.

18. An apparatus as defined in claim 16 wherein said developing means for developing a negative pressure is disposed between said conduits.

19. In a system for delivering to a utilization device liquid from a first of at least two liquid storage comoartments separated by an obstruction, apparatus for transferring liquid to the first compartment from a second compartment comprising, a flow path extending over said obstruction and between said first and second compartments, said flow path including:

(1) a first liquid flow conduit having one end extending into said first compartment, (2) a second liquid flow conduit having one end extending into said second compartment, and (3) means connected to said conduits and responsive to the total flow of the liquid to the utilization device from said first compartment only for transferring liquid from said second compartment to said first compartment as a function of the difference in levels of the liquid in said compartments.

20. An apparatus as defined in claim 19 wherein said means responsive to flow includes means for transferring liquid in both directions between compartments as a function of liquid levels.

21. An apparatus as defined in claim 19 or claim 20 wherein said means is a vortex amplifier.

22. An apparatus as defined in claim 19 further comprising:

a vortex device having an input and an output passage, an outflow pipe from said system to a utilization device, said vortex device having its input and output passages connected in a said flow path with said pipe, said means connected to said conduits further connected to sense a negative pressure in said output passage.

23. An apparatus for equalizing the head of liquid located in at least two compartments of a container, wherein the container includes means for remvoing the liquid from the container, the removing means having an outlet through which the liquid flows from the container, the apparatus comprising a first and a second conduit, said first conduit having a first end which opens into a first of said compartments, said second conduit having a first end which opens into a second of said compartments, and vortex means for developing pressures within said conduits to equalize the liquid heads of the compartments, said first and said second conduits having second ends connected to said developing means, said conduits being connected to said developing means such that the liquid passes through said conduits and said vortex means when the heads are being equalized, said vortex means receiving liquid from the outlet of said removing means and employing said liquid to develop said pressures.

24. An apparatus according to claim 23, wherein the removing means is a pump, said pump being located in said container.

25. An apparatus according to claim 24, wherein said pump has an inlet, said inlet being located in one of said compartments.

26. An apparatus according to claim 25, further comprising a third and a fourth conduits, said third conduit being connected at one end to said outlet of said pump and extending out of said container, said fourth conduit extending between and forming a liquid flow path between said third conduit and said developing means.

27. An apparatus according to claim 26 wherein said means is a vortex amplifier.

28. An apparatus according to claim 26, wherein said vortex means comprises a vortex chamber having a centrally located egress orifice, an enclosure defining a continuous flow path extending outside the periphery of said vortex chamber, said fourth conduit tangentially entering said vortex chamber, said egress orifice directing liquid at one of said first two conduits.

29. An apparatus according to claim 28, wherein said vortex means includes inlet and outlet passageways from said enclosure, said first and said second conduits being connected to said passageways and, wherein the egress is of a lesser diameter than said passageways.

30. An apparatus according to claim 29, wherein said passageways are co-axial with said egress.

31. In a liquid delivery system utilizing a low volume pump to deliver fuel from a compartmented tank to a fuel utilization device wherein the compartment has two chambers with a partition therebetween of a predetermined height above the bottom of the chambers, and wherein the pump is located in one of said chambers and the negative pressure of the pump is insufficient to raise the fuel above the partition and in which due to the low delivery capacity of the pump only minor amounts of fluid can be diverted from the flow of fuel to the utilization device, said system including conduit means extending between said compartments over said partition, and vortex means responsive to flow from said pump to a utilization device for producing a sufficiently negative pressure in said conduit means to raise the fuel in said conduit means above the level of said partition.

* * * * *